US008295524B2

(12) United States Patent
Hsu Huang et al.

(10) Patent No.: US 8,295,524 B2
(45) Date of Patent: Oct. 23, 2012

(54) SPEAKER UNIT TO BE USED FOR PROJECTOR

(75) Inventors: Yueh-Hua Hsu Huang, Zhonghe (TW); Chun-Ti Chen, Zhonghe (TW); Miyashita Yoshiaki, Hsinchu County (TW)

(73) Assignees: Jazz Hipster Corporation, Taipei County (TW); Everest Display Inc., Hsinchu County (TW)

( * ) Notice: Subject to any disclaimer, the term of this patent is extended or adjusted under 35 U.S.C. 154(b) by 346 days.

(21) Appl. No.: 12/835,488

(22) Filed: Jul. 13, 2010

(65) Prior Publication Data

US 2012/0014550 A1 Jan. 19, 2012

(51) Int. Cl.
*H04R 1/02* (2006.01)
*H04R 9/06* (2006.01)

(52) U.S. Cl. ..... 381/333; 381/306; 381/332; 381/386; 381/388; 381/395

(58) Field of Classification Search ..... 381/333, 381/306–308, 332, 386–388, 392–395
See application file for complete search history.

(56) References Cited

U.S. PATENT DOCUMENTS

2010/0316245 A1* 12/2010 Mishra et al. ..... 381/386

* cited by examiner

*Primary Examiner* — Vivian Chin
*Assistant Examiner* — Paul Kim
(74) *Attorney, Agent, or Firm* — Chun-Ming Shih

(57) ABSTRACT

A speaker unit for a projector includes a first speaker, a fixing portion and a second speaker. Either the first speaker or the second speaker has a central hole to hold the vertical post of a projector. Two holes that are diagonally opposing each other are provided in the inner wall of the central hole. The two holes of the fixing portion may align with the two holes of the first speaker and fasteners may be used to fixedly connect the first speaker with the vertical post. A connective portion is provided on either of the two vertical walls of the first speaker and a connective portion is provided on either of the two vertical walls of the second speaker. Therefore, the second speaker may be connected with the first speaker by these connective portions.

9 Claims, 4 Drawing Sheets

SPEAKER UNIT TO BE USED FOR PROJECTOR

BACKGROUND OF THE INVENTION

1. Field of the Invention

The invention generally relates to a speaker unit. More particularly, the invention relates to a speaker unit that may be mounted on the vertical post of a projector.

2. Description of the Prior Art

Projector has been widely used. Projector may be used in homes to allow us to look at magnified video images just like in a movie theater. Projector may be used in offices and classrooms to allow us to see graphs and words clearly.

Most of the projectors sold on the market usually do not come with speakers. Speakers have to be connected to the projector through wires. This is quite inconvenient in terms of use. Some of the projectors sold on the market do come with speakers; however, the speakers are usually of low quality in terms of audio frequency range, SPL (sound pressure level) and low frequency audio signals. Therefore, these projectors can not provide users with a high quality audio output. From the above, we can see that the projectors of the prior art have many disadvantages and need to be improved. To eliminate the disadvantages in the prior art, the inventor has put a lot of effort into the subject and has successfully come up with the speaker unit of the present invention.

SUMMARY OF THE INVENTION

An object of the present invention is to provide a speaker unit that allows two speakers attached to the vertical post of a projector and this makes the installation of speakers easier and simpler and requires no additional space for the speakers. Also, the speaker unit of the present invention would have the same sound effect of the speakers of the prior art.

Another object of the present invention is to provide a speaker unit that is structurally simple and easy to use and may be uninstalled quickly.

To reach these objects, the speaker unit of the present invention is disclosed. The speaker unit of the present invention comprises a first speaker, a fixing portion and a second speaker. Either the first speaker or the second speaker has a central hole to hold the vertical post of a projector. At least one anti-slipping unit is disposed on the inner wall of the central hole and two holes that are diagonally opposing each other are provided in the inner wall of the central hole. The two holes of the fixing portion may align with the two holes of the first speaker and fasteners may be used to fixedly connect the first speaker with the vertical post. The anti-slipping units of the central hole and the fixing portion can keep the speaker unit from slipping down and the friction of these anti-slipping units can hold the speaker unit in place. A connective portion is provided on either of the two vertical walls of the first speaker and a connective portion is provided on either of the two vertical walls of the second speaker. Therefore, the second speaker may be connected with the first speaker by these connective portions. The speaker unit of the present invention is formed by the aforesaid components.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
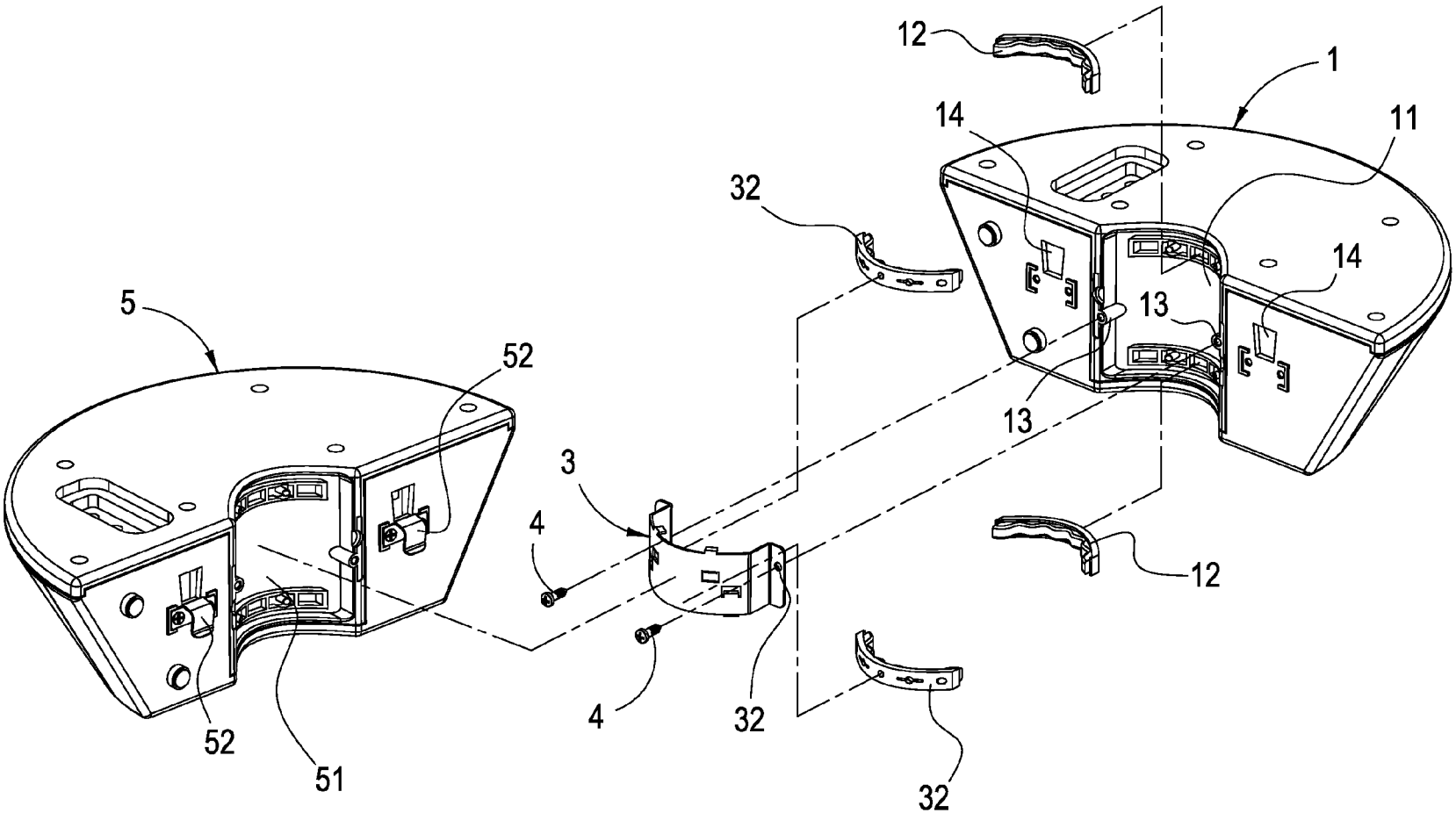
FIG. 1 is an exploded view showing the speaker unit of the present invention.
Figure 2:
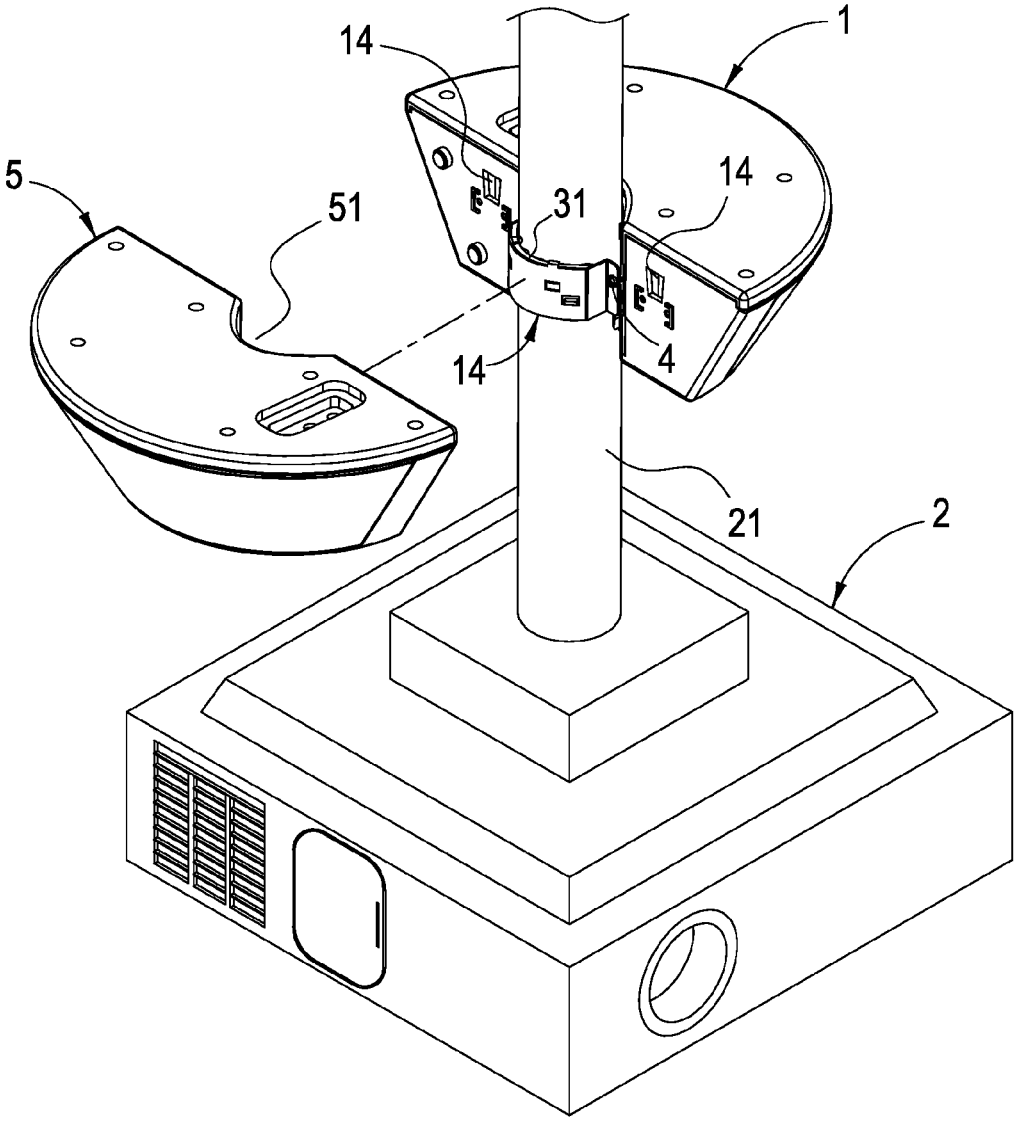
FIG. 2 is a perspective view showing the first speaker is connected with the vertical post of a projector.
Figure 3:
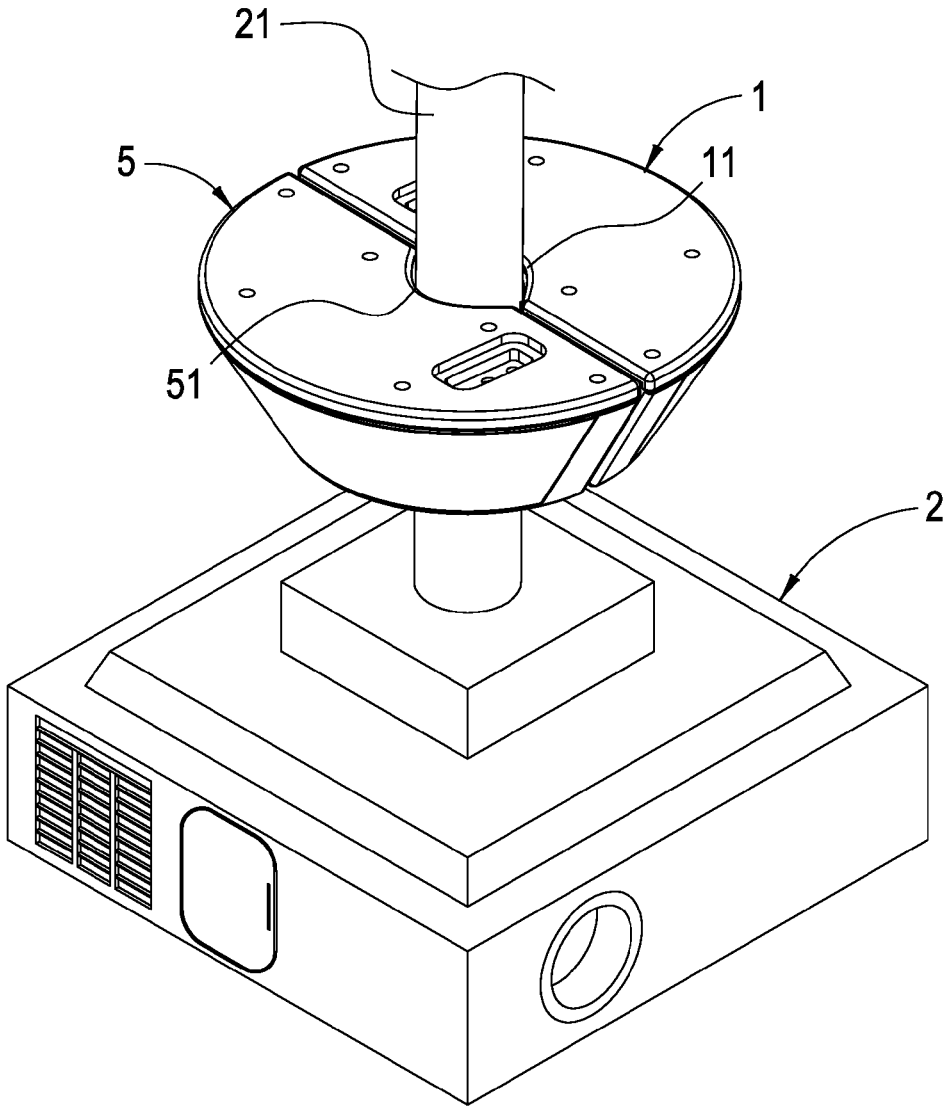
FIG. 3 is a perspective view showing the second speaker is connected with the first speaker.

Please see FIGS. 1 to 3, which illustrate the speaker unit of the present invention. The speaker unit of the present invention comprises a first speaker 1, a fixing portion 3 and a second speaker 5.

A central hole 11 is centrally provided in the first speaker 1 to hold the vertical post 21 of a projector 2. At least one anti-slipping unit 12 is disposed on the inner wall of the central hole 11. Two holes 13 that are diagonally opposing each other are provided in the inner wall of the central hole 11. A connective portion 14 is provided on either of the two vertical walls. The two connective portions 14 may have a female connective design or a male connective design. The inner side of each anti-slipping unit 12 may have a wavy design to increase the friction.

At least one anti-slipping unit 31 is disposed on the inner wall of the fixing portion 3. Two holes 32 that are diagonally opposing each other are provided in the fixing portion 3. The two holes 32 of the fixing portion 3 may align with the two holes 13 of the first speaker 1 and fasteners are used to fixedly connect the first speaker 1 with the vertical post 21 (as illustrated in FIG. 2). The inner side of each anti-slipping unit 31 may have a wavy design to increase the friction.

A central hole 51 is centrally provided in the second speaker 5 to hold the vertical post 21 of the projector 2. A connective portion 52 is provided on either of the two vertical walls. The two connective portions 52 may have a female connective design or a male connective design. The speaker unit of the present invention is formed by the aforesaid components.

In addition, similar to the structure of the first speaker 1, at least one anti-slipping unit (no number is assigned in the drawings) is disposed on the inner wall of the central hole 51 of the second speaker 5 and two holes (no number is assigned in the drawings) that are diagonally opposing each other are provided in the inner wall of the central hole 51.

Also, if the two connective portions 14 of the first speaker 1 have a female connective design, the two connective portions 52 of the second speaker 5 will have a male connective design. Conversely, if the two connective portions 14 of the first speaker 1 have a male connective design, the two connective portions 52 of the second speaker 5 will have a female connective design. Therefore, the two connective portions 14 of the first speaker 1 may connect with the two connective portions 52 of the second speaker 5.

In the installation of the speaker unit of the present invention, the first speaker is connected with the vertical post 21 of the projector 2 and then the second speaker is connected with the first speaker.

Figure 4:
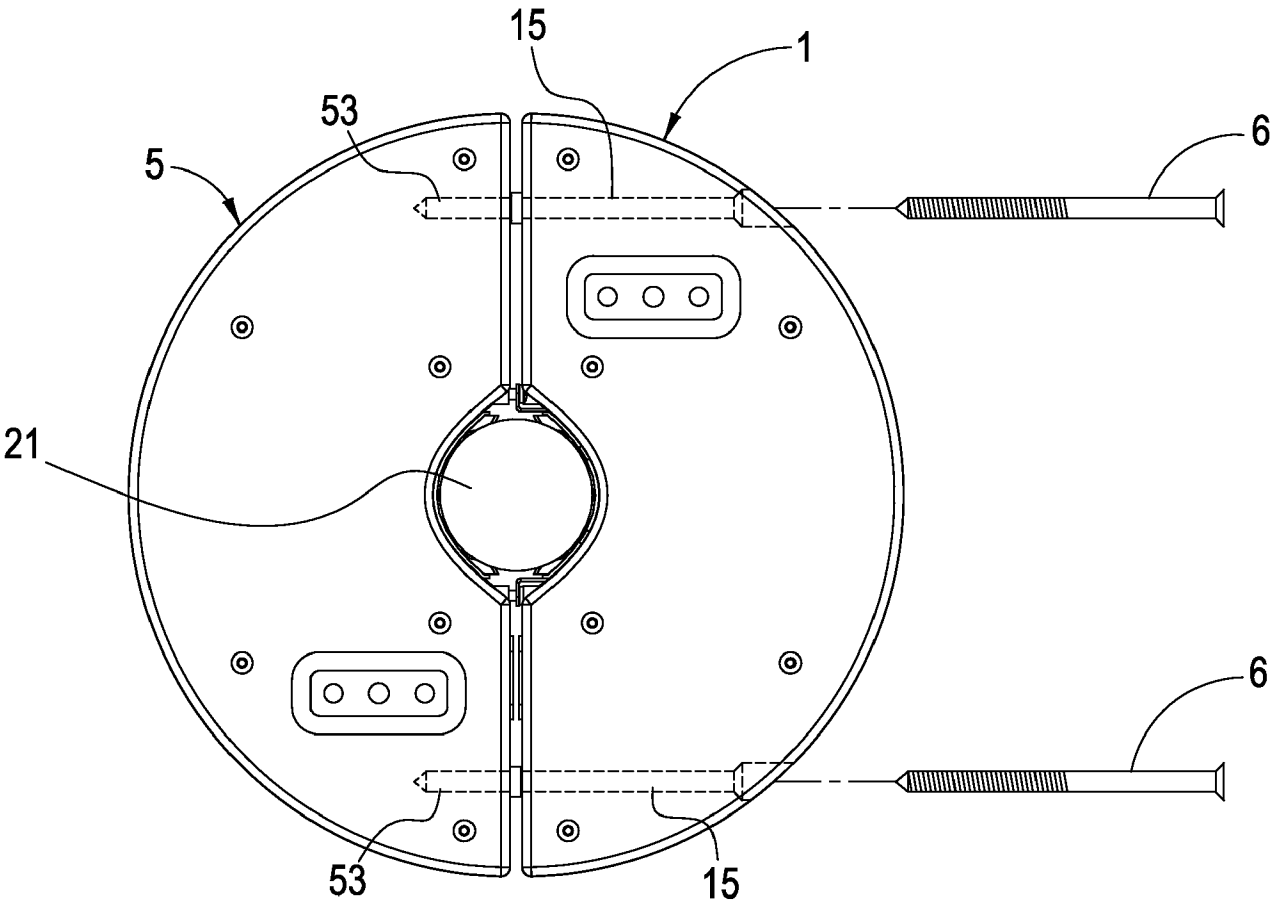
FIG. 4 is a view showing another method that can connect the second speaker with the first speaker.

Please see FIG. 4, which illustrates another method that can connect the second speaker with the first speaker. Two holes 15 and 53 are provided in the first speaker and the second speaker and two fasteners 6 are used to connect the second speaker with the first speaker. Such method can allow the two speakers to be attached to the vertical post 21 of the projector 2.

In comparison to the prior art, the speaker unit of the present invention has the following advantages:

1. In the speaker unit of the present invention, two speakers are attached to the vertical post of a projector and this makes the installation of speakers easier and simpler and requires no additional space for the speakers. Also, the speaker unit of the present invention would have the same sound effect of the speakers of the prior art.
2. The speaker unit of the present invention is structurally simple and easy to use and may be uninstalled quickly.

Although a preferred embodiment of the present invention has been described in detail hereinabove, it should be understood that the preferred embodiment is to be regarded in an illustrative manner rather than a restrictive manner, and all variations and modifications of the basic inventive concepts herein taught still fall within the scope of the present invention. From the above, we can see that the speaker unit of the present invention meets the relevant patent requirements. It is hoped that the patent application will be approved.

What is claimed is:

1. A speaker unit for a projector, comprising:

a first speaker, wherein a central hole is centrally provided in the first speaker to hold a vertical post of a projector and at least one anti-slipping unit is disposed on an inner wall of the central hole, and wherein two holes that are diagonally opposing each other are provided in the inner wall of the central hole and a connective portion is provided on either of two vertical walls of the first speaker;

a fixing portion, at least one anti-slipping unit is disposed on an inner wall of the fixing portion and two holes that are diagonally opposing each other are provided in the fixing portion, and wherein the two holes may align with the two holes of the first speaker and fasteners are used to fixedly connect the first speaker with the vertical post of the projector; and a second speaker, wherein a central hole is centrally provided in the second speaker to hold the vertical post of the projector and a connective portion is provided on either of two vertical walls of the second speaker.

2. The speaker unit as in claim 1, wherein the two connective portions of the first speaker may have a female connective design.

3. The speaker unit as in claim 1, wherein the two connective portions of the first speaker may have a male connective design.

4. The speaker unit as in claim 1, wherein an inner side of each anti-slipping unit of the first speaker may have a wavy design to increase friction.

5. The speaker unit as in claim 1, wherein an inner side of each anti-slipping unit of the fixing portion may have a wavy design to increase friction.

6. The speaker unit as in claim 1, wherein the two connective portions of the second speaker may have a female connective design.

7. The speaker unit as in claim 1, wherein the two connective portions of the second speaker may have a male connective design.

8. The speaker unit as in claim 1, wherein at least one another anti-slipping unit is disposed on the inner wall of the central hole of the second speaker and two holes that are diagonally opposing each other are provided in the inner wall of the central hole of the second speaker.

9. The speaker unit as in claim 1, wherein if the two connective portions of the first speaker have a female connective design, the two connective portions of the second speaker will have a male connective design, and wherein, conversely, if the two connective portions of the first speaker have a male connective design, the two connective portions of the second speaker will have a female connective design so that the two connective portions of the first speaker may connect with the two connective portions of the second speaker.

* * * * *